US008646643B2

(12) United States Patent
Forrest et al.

(10) Patent No.: US 8,646,643 B2
(45) Date of Patent: Feb. 11, 2014

(54) RELIABLE OPENING BEVERAGE CAN END

(75) Inventors: Randall G. Forrest, Park Ridge, IL (US); Jonathan P. Meyer, Libertyville, IL (US); Derek J. Siegal, Chicago, IL (US)

(73) Assignee: Rexam Beverage Can Company, Chicago, IL (US)

( * ) Notice: Subject to any disclaimer, the term of this patent is extended or adjusted under 35 U.S.C. 154(b) by 0 days.

(21) Appl. No.: 13/495,369

(22) Filed: Jun. 13, 2012

(65) Prior Publication Data

US 2013/0334226 A1 Dec. 19, 2013

(51) Int. Cl.
*B65D 17/34* (2006.01)
*B65D 17/347* (2006.01)

(52) U.S. Cl.
USPC ..... 220/272; 220/271; 220/906

(58) Field of Classification Search
USPC ..... 220/272, 271, 906
See application file for complete search history.

(56) References Cited

U.S. PATENT DOCUMENTS

| | | | | |
|---|---|---|---|---|
| 3,536,227 | A | 10/1970 | Markert | |
| 3,593,875 | A * | 7/1971 | Fraze | 220/271 |
| 3,712,503 | A | 1/1973 | Zundel | |
| 3,838,788 | A | 10/1974 | Stargell | |
| 3,891,117 | A | 6/1975 | Dragomier et al. | |
| 3,929,252 | A | 12/1975 | La Croce | |
| 4,014,455 | A * | 3/1977 | LaCroce | 220/269 |
| 4,044,915 | A | 8/1977 | LaCroce et al. | |
| 4,416,389 | A | 11/1983 | Wilkinson et al. | |
| 4,596,342 | A | 6/1986 | Zysset | |
| 5,011,037 | A * | 4/1991 | Moen et al. | 220/271 |
| 5,129,541 | A | 7/1992 | Voigt et al. | |
| 5,397,014 | A * | 3/1995 | Aydt | 220/269 |
| 5,799,816 | A * | 9/1998 | Schubert | 220/269 |
| 6,024,239 | A | 2/2000 | Turner et al. | |
| 6,375,029 | B2 * | 4/2002 | Anthony et al. | 220/271 |
| 6,889,862 | B2 * | 5/2005 | Vaughan | 220/269 |
| 7,677,404 | B2 | 3/2010 | McEldowney et al. | |
| 7,721,906 | B2 | 5/2010 | Heinicke | |
| 8,047,754 | B2 | 11/2011 | Heinicke | |
| 8,109,405 | B2 * | 2/2012 | Butcher et al. | 220/271 |
| 2004/0099665 | A1 | 5/2004 | McEldowney et al. | |
| 2005/0252917 | A1 * | 11/2005 | Turner et al. | 220/269 |
| 2008/0067175 | A1 | 3/2008 | Heinicke | |

(Continued)

OTHER PUBLICATIONS

Rexam Beverage Can Company, International Search Report mailed Oct. 15, 2013 by the European Patent Office acting as International Searching Authority in counterpart PCT Application No. PCT/US2013/045452.

*Primary Examiner* — Mickey Yu
*Assistant Examiner* — Niki Eloshway
(74) *Attorney, Agent, or Firm* — Ungaretti & Harris LLP

(57) ABSTRACT

A can end for a beverage container has a center panel about which a circumferential strengthening member extends. The center panel has a rivet attaching a tab to a public side of the center panel. The tab has a cleat formed at a nose end. The cleat intersects a diametrical line of the can end drawn through a lift end of the tab, the nose end, and the rivet. The cleat extends downwardly towards the public side of a tear panel such that a distance from a lowermost portion of the cleat to the tear panel is less than a distance of an uppermost portion of the cleat to the tear panel. The cleat has a compressed portion of the curled portion forming a substantially V-shaped crevice on an upper surface of the tab.

19 Claims, 7 Drawing Sheets

(56) References Cited

U.S. PATENT DOCUMENTS

2010/0028104 A1 2/2010 Heinicke
2010/0124475 A1 5/2010 McEldowney et al.
2011/0036840 A1 2/2011 Zakai
2011/0147382 A1 6/2011 Mitchell et al.
2011/0226636 A1* 9/2011 Petti ..... 206/216

* cited by examiner

RELIABLE OPENING BEVERAGE CAN END

CROSS-REFERENCE TO RELATED APPLICATIONS

N/A

FEDERALLY SPONSORED RESEARCH OR DEVELOPMENT

N/A

TECHNICAL FIELD

The present invention relates to beverage can ends for two-piece beer and beverage metal containers, having a frangible tear panel and a retained-tab secured by a rivet. More specifically, the present invention relates to improved characteristics for opening the frangible tear panel of the beverage can end.

BACKGROUND OF THE INVENTION

Typical beverage can ends for beer and beverage containers have an opening panel and an attached leverage tab for pushing the opening panel into the container to open the end. The container is typically a drawn and ironed metal can, usually constructed from a thin plate of aluminum or steel. Beverage can ends for such containers are also typically constructed from a cutedge of thin plate of aluminum, formed into a blank end, and manufactured into a finished end by a process often referred to as end conversion. These ends are formed by the process of first forming a cutedge of thin metal, forming a blank end from the cutedge, and converting the blank into a beverage can end which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a score length. The tear panel may be opened, that is the score may be severed, and the tear panel displaced at an angular orientation relative to the remaining portion of the can end. The tear panel remains hingeably connected to the remaining portion of the can end by a hinge segment, leaving an opening through which the user draws the contents of the container. In an LOE, the opening is at least 0.5 square inches in area.

Opening of the tear panel is operated by the tab which is attached to the can end by a rivet. The tab is attached to the can end such that a nose of the tab extends over a proximal portion of the tear panel. A lift end of the tab is located opposite the tab nose and provides access for a user to lift the lift end, such as with the user's finger, to force the nose against the proximal portion of the tear panel.

When the tab nose is forced against the tear panel, the score initially ruptures at a vent region of the score. This initial rupture of the score is primarily caused by the lifting force on the tab resulting in lifting of a central region of the can end, immediately adjacent the rivet. As the tab is lifted further, the score rupture propagates along the length of the score, eventually stopping at the hinge segment.

Throughout the use of ecology can ends, manufacturers have sought to save the expense of the metal by downgauging the metal of the ends and tabs. However, because ends are used for containers with pressurized contents, the score of the opening panel must have sufficient score residual to withstand such pressure, which in turn requires that the tab have a thickness of metal to provide strength to open the panel. Further, with the popular use of LOEs, additional problems arise with regard to openability of the ends. Because of the enlarged size of the opening panel (or tear panel), more stress is placed on the tab during opening of the tear panel, constraining efforts to further downgauge the tab. Also, the score in certain regions of the large-open tear panel are more difficult to open by the tab leveraging against the tear panel. This is especially true for the region of the score which is in the 5:00 to 6:00 clock position (with the rivet and tab nose being the 12:00 position).

Further, abuse during shipping, retail stocking and vending, due to rough handling of the filled containers, often causes problems with openability of the end. As an example of a problematic condition caused by handling abuse is the poor openability of a buckled container end. Due to dropping or abusive handling of filled containers, excessive pressure loads on regions of the end may cause a buckle of the end material. Such abuse, typically caused by dropping an upright container that is filled with carbonated fluid, results in a buckled end panel that deforms to form a bulge of metal of the panel.

The possibility of such buckling is a prevalent concern due to down-gauging of the end material, pressurization of the container, pasteurizing filled containers, environmental conditions such as excessive heat, and rough handling of pallets or cases of filled containers. In a metal container end, the buckle appears as a deformation or bulge of the metal in a region of the end panel, a condition that adversely affects the user's ability to open the end. Due to the geometry of the container and the ecology end panel, buckling of the end frequently is noticeable as a bulge of the end with a buckle in the 5:00 to 7:00 range of the end (with the middle of the tear panel positioned at 6:00). This type of buckled container end very often results in opening failure and resulting problems of a user trying to open the end.

Such a buckled end usually cannot be opened properly by the user. Instead, when the user lifts the tab and applies pressure on the tear panel with the tab nose, the score fractures at the wrong locations at the wrong time, usually resulting in a dramatic loss in leverage of the tab for opening the panel. In this situation, the tab is actuated against the tear panel by lifting the finger pull end of the tab, but the tab nose passes beyond the proximal peripheral edge of the tear panel, a condition often called "tuck under" of the tab. (See FIG. 11).

The tab that tucks under is, therefore, fully lifted by the user, though the tear panel is still not fully opened. In this situation, the tear panel remains attaches by a segment of the score usually at about the 5:00 to 11:00 of the tear panel (defined with the tab nose being at about the 12:00 region of the tear panel). When this condition occurs, the user often tries to open the tear panel with something other than the tab, often by applying force by an object or the user's finger.

Further, with LOEs, such problems with buckled ends are potentially greater. Because of the enlarged size and the shape of the opening panel (or tear panel), the score in certain regions of the large-open tear panel are more difficult to open by the tab leveraging against the tear panel. This is especially true for the region of the score which is in the 5:00 to 6:00 clock position. Therefore, large-opening ends may be difficult to open even when there is no noticeable sign of damage or buckle. Because of the additional force that may be required to open the large-opening tear panel with a tab, there may be more likelihood for non-specific tear of the metal away from the score. Also, because of the difficulty in opening the large-opening end, there is an increase in potential opening failure that results in "tuck under" of the tab. This type of opening failure also may result from the user opening the container too rapidly.

Because of these conditions, and the problem of potential tuck under of the tab, there is a need for an improved end structure that prevents or inhibits the total removal of the tear panel in the situation of an opening failure.

The present invention is provided to solve the problems discussed above and other problems, and to provide advantages and aspects not provided by prior beverage can ends of this type. A full discussion of the features and advantages of the present invention is deferred to the following detailed description, which proceeds with reference to the accompanying drawings.

SUMMARY OF THE INVENTION

An aspect of the present invention is directed to a can end for a beverage container. The can end comprises a curl, a circumferential wall, a circumferential strengthening member, and a center panel. The curl extends circumferentially about a longitudinal axis. The circumferential wall extends downwardly from a radially inner portion of the curl. The circumferential strengthening member is joined to lower segment of the circumferential wall. The circumferential strengthening member extends about the center panel. The center panel has a public side opposite a product side. The center panel comprises a peripheral edge, a tear panel, a tab, and a means for attaching the tab to the center panel. The peripheral edge defines a radially outer perimeter of the center panel. The tear panel is spaced radially inwardly from the peripheral edge and is defined by a frangible score in the public side and non-frangible hinge segment. The means for attaching the tab to the center panel is spaced from the tear panel. The tab comprises a lift end, a nose end a rivet island, a void region, a tab hinge, a curled portion, and a cleat. The nose end is opposite the lift end and overlays the tear panel. The rivet island has a rivet aperture. The void region partially surrounds the rivet island and has a first leg extending along a first side of the rivet island and a second leg extending along a second side of the rivet island. The tab hinge extends between respective terminal ends of the first and second legs of the void region. The curled portion of the tab defines a portion of the perimeter of the tab and is bent downwardly towards the public side of the center panel. The curled portion extends at least from a terminal end of the first leg to a terminal end of the second leg through the nose end. The cleat is formed at the nose end intersecting a diametrical line of the can end drawn through the lift end, the nose end, and the rivet aperture and extending downwardly towards the public side of the tear panel such that a distance from a lowermost portion of the cleat to the tear panel is less than a distance of an uppermost portion of the cleat to the tear panel, the cleat comprising a compressed portion of the curled portion forming a substantially V-shaped crevice on an upper surface of the tab.

This aspect of the invention may include one or more of the following features, alone or in any reasonable combination. The V-shaped crevice may comprise a first wall separated from a second wall by a bottom point, the first wall angled from a vertical plane intersecting the bottom point at an angle between 5 and 35 degrees. The second wall may be angled from a vertical plane intersecting the bottom point at an angle between 5 and 35 degrees. The compressed portion of the curled portion of the tab may extend downwardly towards the public side of the center panel a greater distance than a portion of the curled portion of the tab directly adjacent the compressed portion of the curled portion. The cleat may extend outwardly relative to the longitudinal axis and along the diametrical line a greater length than portions of the curled portion of the tab directly adjacent the cleat. The first leg may have a length greater than the second leg. The hinge line may be at an oblique angle to the diametrical line. The compressed portion of the curl may extend downwardly towards the public side of the center panel a greater distance than portions of the curled portion directly adjacent the compressed portion of the curled portion and on opposing sides of the cleat.

A second aspect of the invention is directed to a can end for a beverage container comprising a curl, a circumferential wall, a circumferential strengthening member, and a center panel. The curl extends circumferentially about a longitudinal axis. The circumferential wall extends downwardly from a radially inner portion of the curl. The circumferential strengthening member is joined to lower segment of the circumferential wall. The center panel, about which the circumferential strengthening member extends, has a public side opposite a product side. The center panel comprises a peripheral edge, a tear panel, a tab, and a means for attaching the tab to the center panel. The peripheral edge defines a radially outer perimeter of the center panel. The tear panel is spaced radially inwardly from the peripheral edge, the tear panel defined by a frangible score in the public side and non-frangible hinge segment. The means for attaching the tab to the center panel is spaced from the tear panel. The tab comprises a lift end, a nose end, a rivet island, a void region, a tab hinge, and a cleat. The nose end is opposite the lift end and overlies the tear panel. The rivet island has a rivet aperture. The void region partially surrounds the rivet island and has a first leg extending along a first side of the rivet island and a second leg extending along a second side of the rivet island wherein the first leg has a length greater than the second leg. The tab hinge extends between respective terminal ends of the first and second legs of the void region wherein the hinge line is at an obtuse angle to a diametrical line of the can end drawn through the lift end, the nose end, and the rivet aperture. The cleat is formed at the nose end and extends outwardly relative to the longitudinal axis from the nose end along the diametrical line.

This aspect of the invention may include one or more of the following features, alone or in any reasonable combination. The cleat may extend outwardly relative to the longitudinal axis a greater length than curled portions of the tab directly adjacent to and on opposing sides of the cleat. The cleat may intersect the diametrical line. The cleat may extend downwardly relative to portions of the tab directly adjacent to the cleat. An upper surface of the cleat may be V-shaped transverse to the diametrical line. A bottom surface of the cleat may be bow-shaped transverse to the diametrical line.

A third aspect of the invention is directed to a can end for a beverage container comprising a curl, a circumferential wall, a circumferential strengthening member, and a center panel. The curl extends circumferentially about a longitudinal axis. The circumferential wall extends downwardly from a radially inner portion of the curl. The circumferential strengthening member is joined to lower segment of the circumferential wall. The center panel, about which the circumferential strengthening member extends, has a public side opposite a product side. The center panel comprises a peripheral edge, a tear panel, a tab, and a means for attaching the tab to the center panel. The peripheral edge defines a radially outer perimeter of the center panel. The tear panel is spaced radially inwardly from the peripheral edge, the tear panel defined by a frangible score in the public side and non-frangible hinge segment. The means for attaching the tab to the center panel is spaced from the tear panel. The tab comprises a lift end, a nose end, a rivet island, a void region, a tab hinge, and a cleat. The nose end is opposite the lift end and overlies the tear panel. The rivet island has a rivet aperture. The void region partially surrounds the rivet island and has a first leg extending along a first side of the rivet island and a second leg extending along a second side of the rivet island wherein the first leg has a length greater than the second leg. The tab hinge extends between respective terminal ends of the first and second legs of the void region wherein the hinge line is at an obtuse angle to a diametrical line of the can end drawn through the lift end, the nose end, and the rivet aperture. The cleat is formed at the nose end and intersects the diametrical line and extends downwardly towards the public side of the tear panel such that a distance from a lowermost portion of the cleat to the tear panel is less than a distance of an uppermost portion of the cleat from the tear panel.

This aspect of the invention may include one or more of the following features, alone or in any reasonable combination. A curled portion of the tab may define at least a portion of a perimeter of the tab from a terminal end of the first leg to a terminal end of the second leg through the nose end of the tab, including the cleat, and wherein the cleat may comprise a compressed portion of the curled portion extending downwardly towards the public side of the center panel a greater distance than portions of the curled portion of the tab directly adjacent the compressed portion of the curled portion and on opposing sides of the cleat. The diametrical line may bisect the cleat. An upper surface of the cleat may be V-shaped transverse to the diametrical line.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
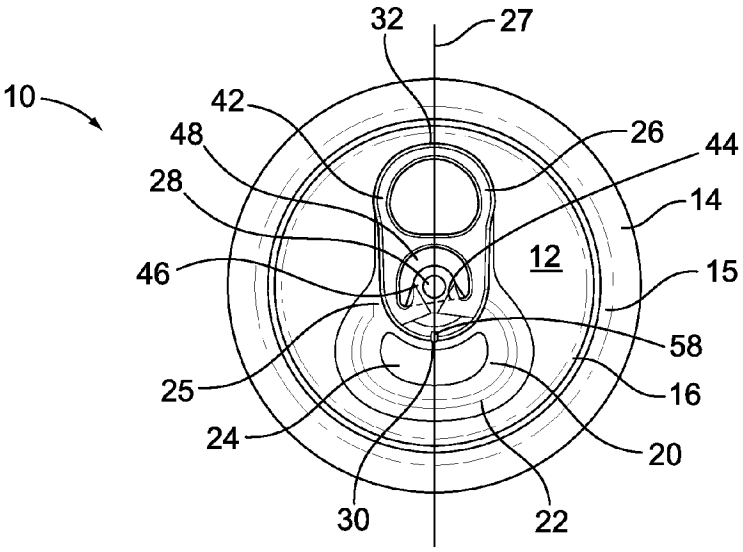
FIG. 1 is a top view of a can end of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2:
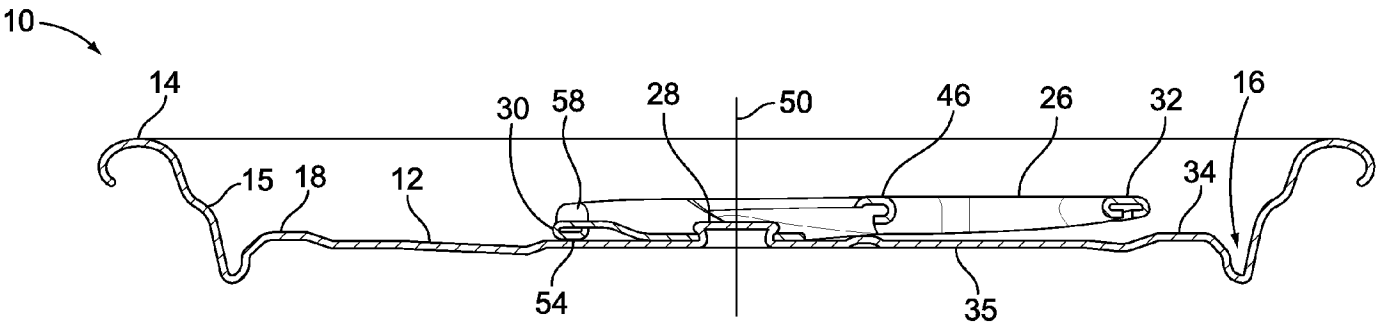
FIG. 2 is a cross-sectional view of the can end of FIG. 1.
Figure 3:
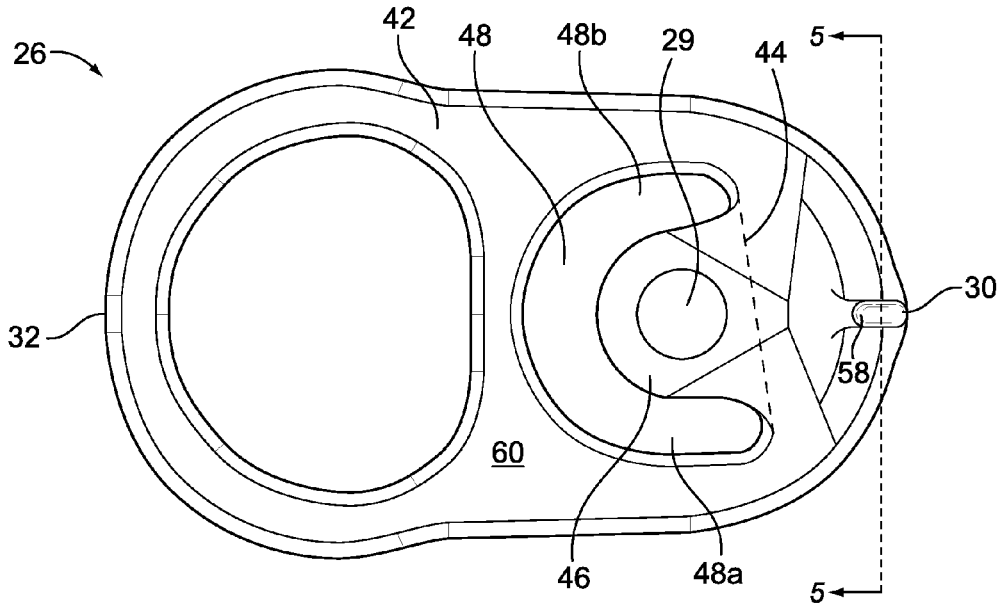
FIG. 3 is top view of a tab for use on a can end of the present invention.
Figure 4:
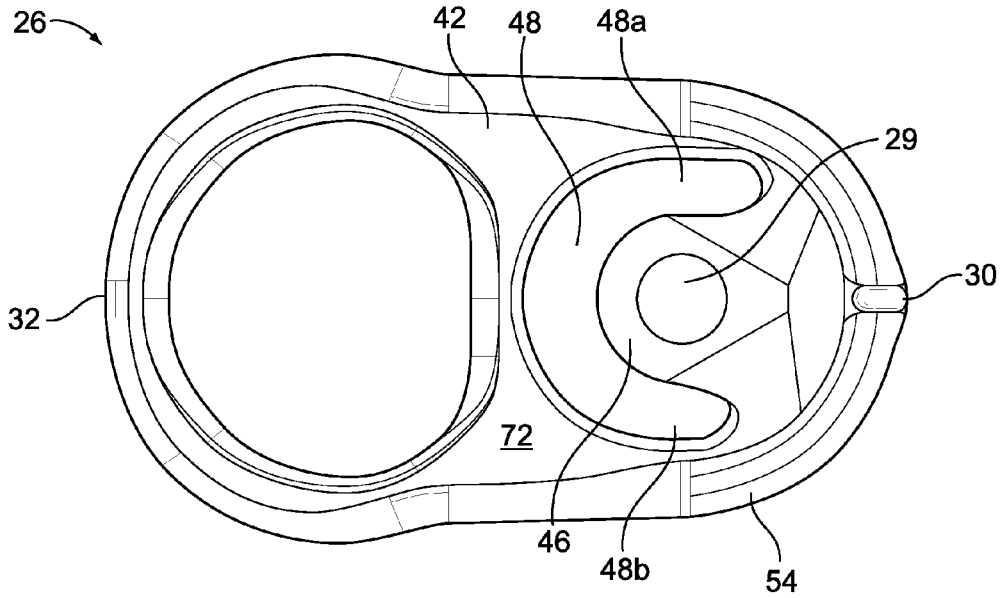
FIG. 4 is a bottom view of the tab of FIG. 4.
Figure 5:
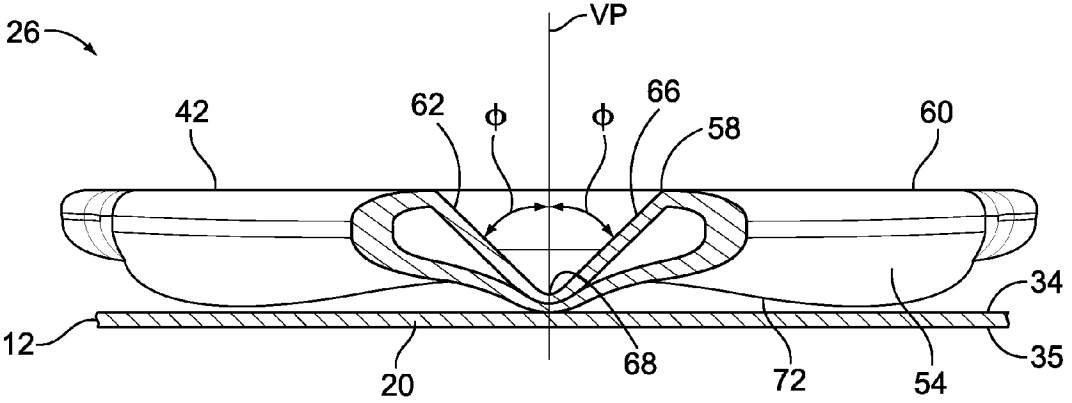
FIG. 5 is a cross-sectional view of the tab of FIG. 4.
Figure 6:
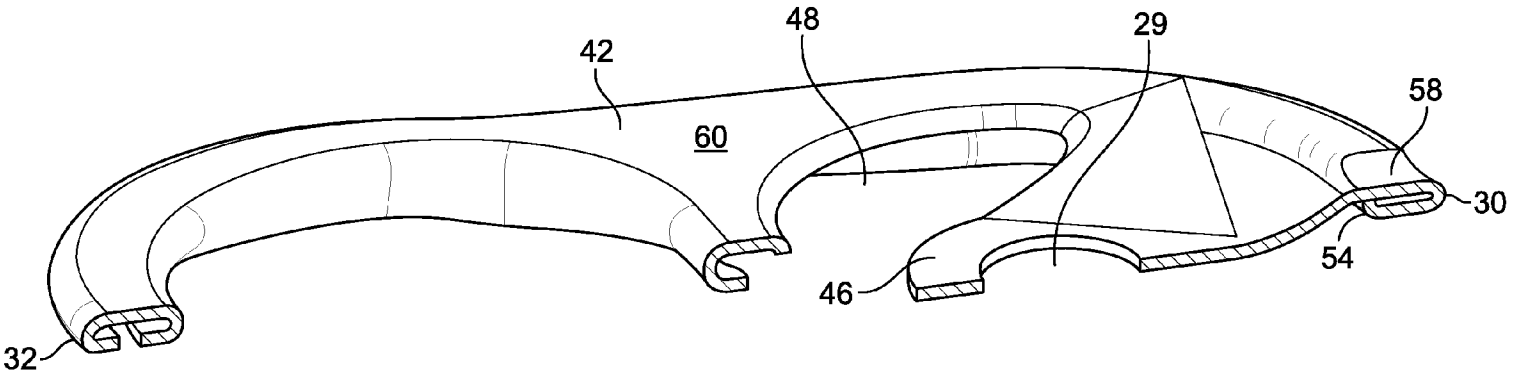
FIG. 6 is an isometric cross-sectional view of the tab of FIG. 4.
Figure 7:
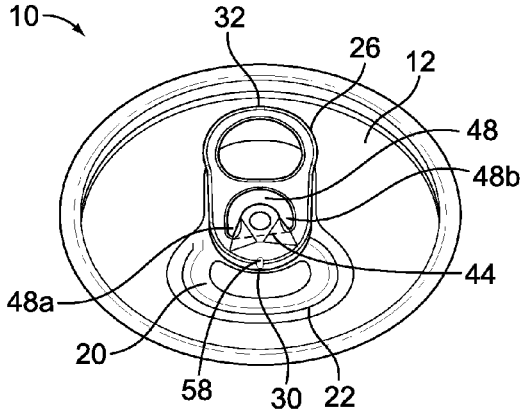
FIGS. 7-10 show an opening sequence of the can end of FIG. 1.
Figure 8:
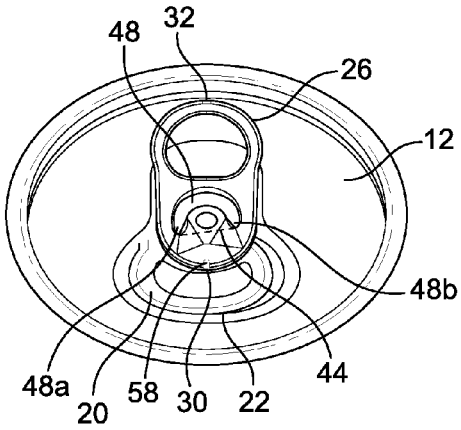
Figure 9:
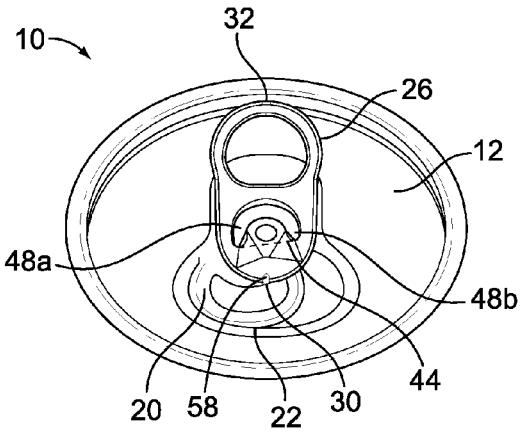
Figure 10:
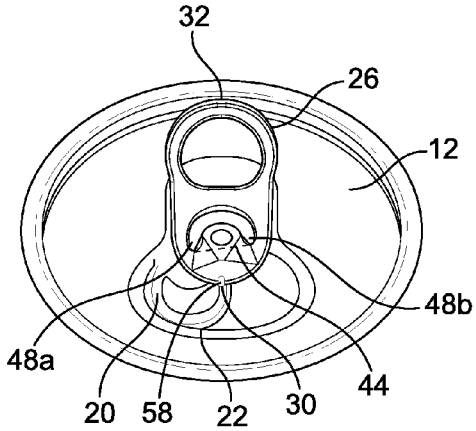

Referring to the FIGS. 1 and 2, a beverage can end for a container has a center panel 12 separated from a seaming curl 14 by a circumferential wall 15 extending downwardly from the seaming curl 14 to a strengthening member 16 which is joined to the center panel 12. The container is typically a drawn and ironed metal can, usually constructed from a thin plate of aluminum or steel. Beverage can ends for such containers are also typically constructed from a cutedge of thin plate of aluminum or steel, formed into blank end, and manufactured into a finished end by a process often referred to as end conversion.

In the embodiment shown in the Figures, the can end 10 can be joined to a container by the seaming curl 14 which is joined to a mating curl of the container. The seaming curl 14 of the can end 10 is integral with the center panel 12 by the circumferential wall 15 and a strengthening member 16, typically either a countersink or a fold, which is joined to a peripheral edge 18 of the center panel 12 often through an additional strengthening feature such as a circumferential step or other circumferential wall. This type of means for joining the center panel 12 to a container is presently the typical means for joining used in the industry, and the structure described above is formed in the process of forming the blank end from a cutedge of metal plate, prior to the end conversion process. However, other means for joining the center panel to a container may be employed with the present invention.

The steps of manufacturing the end begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the center panel.

The conversion process for this type of beverage can end includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island.

The seaming curl 14 defines an outer perimeter of the beverage can end 10. It is generally centered about a longitudinal or vertical axis 50.

The center panel 12 has a displaceable tear panel 20 defined by a frangible score 22 and a non-frangible hinge segment 25. The tear panel 20 of the center panel 12 may be opened, that is the frangible score 22 may be severed and the tear panel 20 displaced at an angular orientation relative to the remaining portion of the center panel 12, while the tear panel 20 remains hingeably connected to the center panel 12 through the hinge segment. In this opening operation, the tear panel 20 is displaced at an angular deflection. More specifically, the tear panel 20 is deflected at an angle relative to the plane of the panel 12, with the vortex of the angular displacement being the hinge segment 25.

The tear panel 20 is formed during the conversion process by a scoring operation. The tools for scoring the tear panel 20 in the center panel 12 include an upper die on the public side having a scoring knife edge in the shape of the tear panel 20, and a lower die on the product side to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score is formed by the scoring knife edge causing movement of metal, such that the imprint of the scoring knife edge is made in the public side of the panel wall 12.

The center panel 12 further includes a tab 26. The tab 26 has a generally elongated body along a diametrical line 27 extending through the tab nose 30, a central webbing 42 and the lift end 32. Typical prior art container ends often have a tab 26 which is staked in the final steps of the conversion process by staking the area of the center panel 12 adjacent and under the rivet island 46 at an angle, to bias the tab 26 such that the lift end 32 of the tab 26 rests close to the center panel 12. The center panel 12 may also have a recess near the lift end 32 of the tab 26 to allow for easier finger access.

The figures represent only one example of the rivet island 46 configuration. However, those individuals who are ordinary skilled in the art would understand that the rivet island 46 and the void region 48 can take any number of shapes without departing from the spirit of the invention, including but not limited to all notch or lance type rivet islands.

The opening of the tear panel 20 is operated by the tab 26 which is attached to the center panel 12 by a rivet 28, generally through a rivet aperture 29 in the rivet island 46. The tab 26 is attached to the center panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

Alternatively, the tab 26 may be attached to the center panel 12 by an adhesive.

An opening sequence is illustrated in FIGS. 7-10. When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

The tab 26 has a central webbing 42 located between the nose 30 and the lift end 32. The central webbing 42 includes a hinge region and a rivet island 46 surrounding the rivet 28. An opening or void region 48 of the tab webbing 42 provides an exposed area of the center panel 12. The void region 48 has a curvilinear geometry which borders the rivet island 46 and at least partially surrounds the rivet 28, with a first leg of the void region 48 being disposed generally to one side of the rivet 28, and a second leg being generally disposed on an opposite side of the rivet 28. The hinge region of the tab webbing 42 includes a hinge line which is defined by a substantially straight line passing between a terminal end of the first leg and a terminal end of the second leg of the void region 48. It may also be necessary to add material to the tab webbing 42, modify the radius of the curl, add beading, or other strengthening means to ensure that this area is strong enough wherein the tab 26 bends at the hinge region during opening.

The void region 48 is within the tab webbing 42. The void region 48 may have a generally arch-shaped configuration. In this configuration, the rivet island 46 again follows the general shape of the void region 48.

According to one embodiment of the present invention, the hinge region of the tab 26 is adapted to have a hinge line 44 which is not perpendicular to the diametrical line 27. Rather, the hinge line 44 intersects the diametrical line 27 at an oblique angle. Thus, one embodiment of the present invention has a void region 48 with a first leg **48*a* which is closer to an outer edge of the tab nose 30, and closer to the tear panel 20, than the second leg 48*b*. Thus, the hinge line 44 of the tab 26 is oriented at an oblique angle relative to the diametrical line, as it is neither parallel nor perpendicular to the diametrical line 27**.

The alteration of the hinge line 44 orientation relative to the diametrical line 27 tab 26, as described above, results in a structure which directs the path of the tab 26 during opening of the tear panel 20, caused by lifting force on the lift end 32 to rotate the tab 26 about the hinge line 44 and cause angular displacement of the tab body.

When the consumer opens the can end 10 by lifting the lift end 32 of the tab 26, the tab webbing 42 bends along the hinge line 44, which results in the hinge line 44 being a fulcrum line of the tab angular displacement. Because the hinge line 44 is at an oblique angle relative to the diametrical line 27, the rotational path of the tab being lifted and the respective downward path of the tab nose 30 is likewise at an oblique angle relative to the diametrical line 27, as it is not in alignment with or parallel to diametrical line 27. In this manner, the nose 30 of the tab 26 is deflected downward toward the tear panel 20 at an angle relative to the center panel 12, such that the nose 30 of the tab 26 contacts the tear panel 20 at a point to the side of the diametrical line 27. Preferably, the initial contact point of the tab nose 30 is on the side of the tear panel 20 toward the direction of the score propagation; that is, the side closest to the region of the scoreline which propagates immediately after the initial rupture of the score. The oblique hinge line 44 is described in U.S. Pat. No. 6,024,239 which is hereby incorporated by reference as if fully set forth herein.

For example, as shown in the Figures, having the hinge line 44 of the tab 26 at an oblique angle relative to the diametrical line 27 directs the tab 26 at an angle. After initial pop of the score, the lifting force is continued and the score fracture propagates, such that the tab continues to deflect at an angle, maintaining the contact point and leverage of the nose 30 generally to the region of the tear panel 20 of continued score propagation.

Referring to FIGS. 2-6, the tab 26 also has a curled portion 54 about its perimeter. The curled portion 54 strengthens the tab 26 and also hides any sharp edges. The curled portion 54 is generally about the entire perimeter of the tab 26 with slit portions to accommodate the rounded contour of the tab 26 and avoid wrinkling of the metal of the tab 26. The curled portion 54 is at least formed from the terminal end of the first leg 48*a* to the terminal end of the second leg 48*b* of the void region 48 through the nose end 30. The curled portion 54 comprises metal from the tab rolled downwardly.

To enhance openability of the can end 10, a feature is added to the nose end 30 of the tab 26. This feature is a cleat 58. The cleat 58 is generally located near the nose end 30 of the tab 26, preferably within ±10° of the diametrical line 27, more preferably intersecting the diametrical line 27, and most preferably bisected by the diametrical line 27.

Structurally, the cleat 58 comprises a compressed portion of the curled portion 54 and substantially V-shaped crevice on an upper surface 60 of the tab 26. The V-shaped crevice comprises a first wall 62 separated from a second wall 66 by a bottom point 68. The first and second walls 66,68 are angled from a vertical plane VP intersecting the bottom point 68 at an angle $\phi$ between 5° and 35°. While the bottom of the crevice is referred to the bottom point 68, it comprises a curved segment with a radius of curvature, rather than a sharp point with a very, very small radius of curvature.

Figure 12:
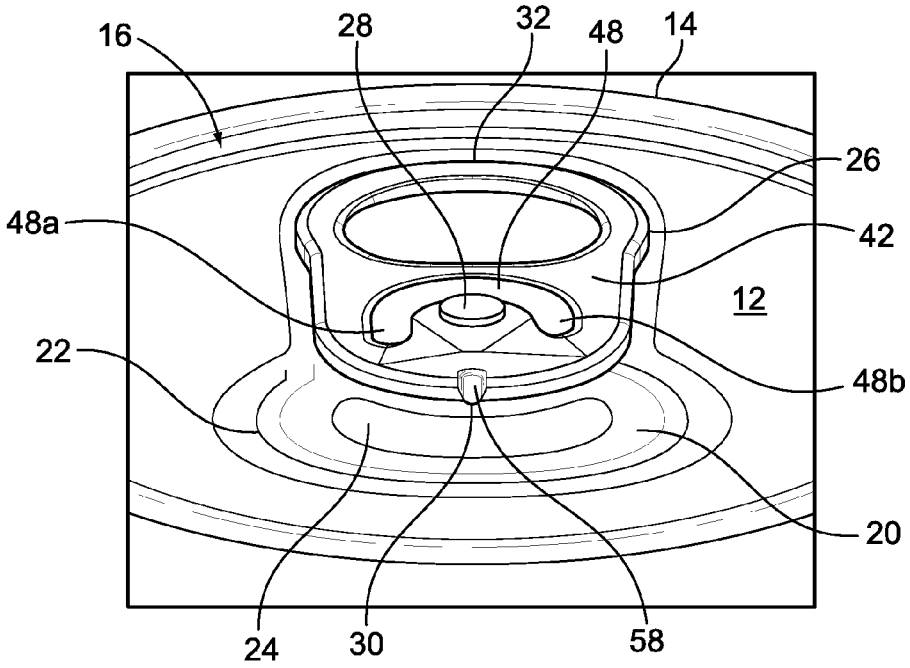
FIG. 12 is a close up view of a can end of the present invention, showing a cleat having a lowermost portion in contact with a tear panel on a center panel of the can end.

The cleat 58 is formed by striking the upper surface 60 of the tab 26. This compresses the curled portion 54 at the upper surface 60 and forces a bottom surface 72 of the tab 26 downwardly. Thus, a compressed portion of the curled portion 54 extends downwardly towards the public side 34 of the center panel 12 a greater distance than a portion of the curled portion 54 directly adjacent the compressed portion of the curled portion 54. (See FIGS. 5 and 12).

Thus, the cleat 58 has an upper surface exhibiting a V-shaped crevice and a lower surface extending downwardly towards the public side 34 of the tear panel 20. The lower surface of the cleat 58 differs structurally from the upper surface. The lower surface forms a bow-shape transverse to the diametrical line 27 rather than the V-shape exhibited by the upper surface. (See FIG. 5). This structural characteristic also reduces an angle $\theta$ between a bottom surface of the tab 26 and the public side 34 of the center panel 12, creating quicker contact between the tab 26 and the tear panel 20 during opening and reducing some rocking of the tab 26 on the rivet 28.

Figure 13:
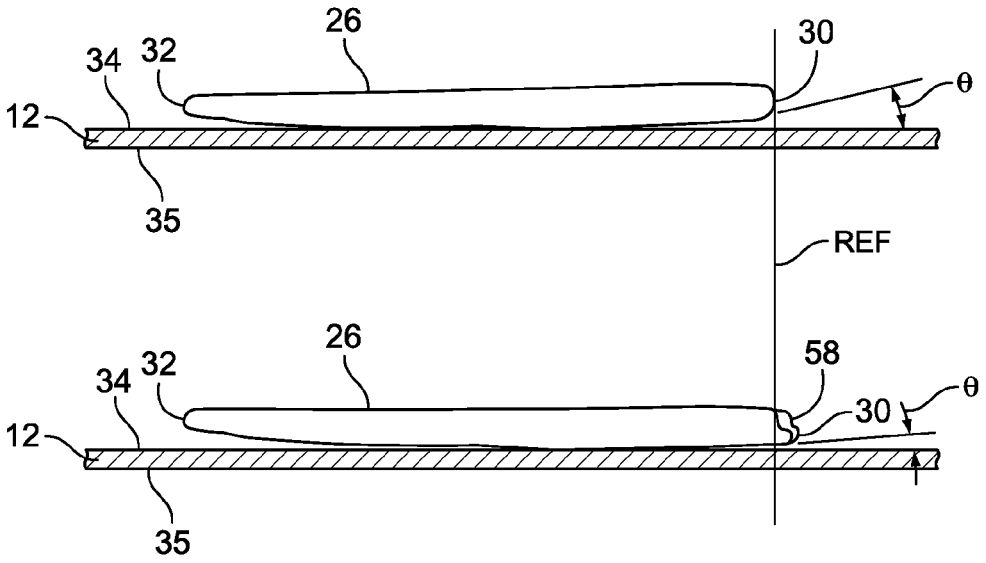
FIG. 13 is side view comparison of a tab without a cleat and a tab of the present invention beneath it, showing an additional length added by a cleat and a decreased angle between the lift end of the tab and the center panel.
Figure 14:
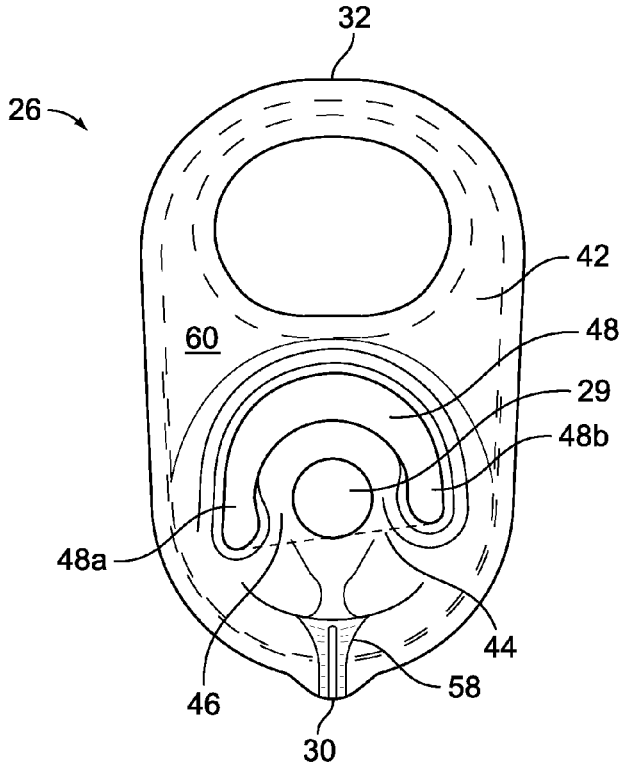
FIG. 14 is a top plan view of a tab of the present invention.
Figure 15:
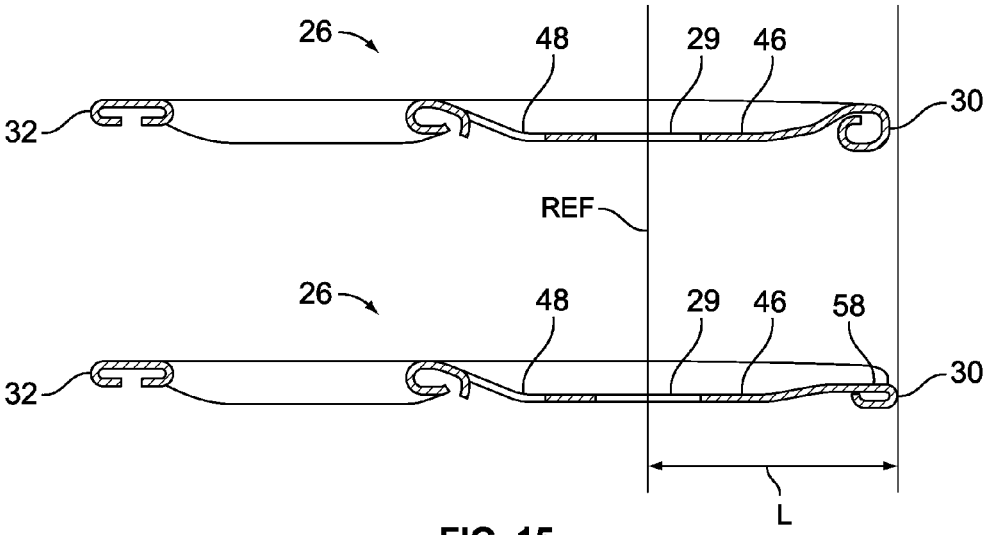
FIG. 15 is a cross-sectional comparison of a tab without a cleat (bottom, cross-section taken through the cleat) and a tab of the present invention above it, showing an additional length added by a cleat.

The forming of the cleat 58 also forces the curled portion 54 radially outwardly relative to the longitudinal axis 50. Thus, the cleat 58 extends radially outwardly along the diametrical line 27 from the nose end 32. This effectively lengthens the tab 26 at the cleat 58 wherein the cleat 58 extends farther outwardly from the longitudinal axis 50 at the center of the rivet aperture 29 and the rivet 28 relative to portions of the perimeter of the tab 26 directly adjacent and on opposing sides of the cleat 58. In other words, the cleat 58 increases a length L of the tab 26 from the longitudinal axis 50 passing through a center of the rivet aperture 29 to the nose end of the tab. This is best illustrated in FIGS. 13 and 15 which show standard tabs in comparison to tabs of the present invention. A reference line REF helps illustrate the lengthening achieved by the cleat 58. Additionally, the angle $\theta$ between the bottom surface of the tab 26 and the public side 34 of the center panel 12 is also reduced by the cleat 58.

Thus, the tab 26 of the present invention has a length from the lift end 32 to the nose end 30 through the rivet aperture 29 that is longer than prior stay-on tabs of this type, and a distance between a center of the rivet aperture 29 at the longitudinal axis 50 to the tab nose 30 is lengthened compared to the prior art tabs. Prior to the development of the cleat 58, the shorter tab would slide back during opening causing an opening failure. Table 1 shows an increased length of tabs having cleats as compared to control tabs having no cleat.

TABLE 1

Increased Tab Length from Center of Rivet to Nose End of Tab

| Description | Nose Length from Rivet L (ins) |
|---|---|
| Cleat formed by Punch Only | 0.317 |
| Cleat formed by Punch and Die | 0.315 |
| Cleat formed with Die Only | 0.307 |
| Control A (No Cleat) | 0.306 |
| Control B (No Cleat) | 0.305 |
| Control C (No Cleat) | 0.307 |

Further to FIG. 13, a tab 26 without a cleat is positioned directly above a tab 26 having a cleat 58. FIG. 13 shows that a distance from a bottom surface of the nose end 30 of the tab 26 to the center panel 12 is greater distance without the cleat 58 than with it. By adding the cleat 58, the inventors made the bottom surface of the tab 26 flatter, and it does not slide back during opening.

In one embodiment, the cleat 58 is formed at the nose end 30. The cleat 58 intersects the diametrical line 27 of the can end 10 which is drawn through the lift end 32, the nose end 30, and the rivet aperture 29. The cleat 58 extends downwardly towards the public side 34 of the tear panel 20 such that a distance from a lowermost portion of the cleat 58 to the tear panel 20 is less than a distance of an uppermost portion of the cleat 58 from the tear panel 20. The distance of the lowermost portion of the cleat 58 from the public side 34 of the tear panel 20 is less than a distance from the tear panel 20 the portions of the curled portion 54 directly adjacent opposing sides of the cleat 58. The cleat 58 comprises a compressed portion of the curled portion 54 and forms a substantially V-shaped crevice on the upper surface 60 of the tab 26.

In one embodiment, the cleat 58 is formed at the nose end 30 of the tab 26 and extends outwardly relative to the longitudinal axis 50 from the nose end 30 along the diametrical line 27. The cleat 58 extends farther outwardly relative to portions of the perimeter of the tab 26 directly adjacent the cleat 58 and on opposing sides of the cleat 58.

In one embodiment, the cleat 58 is formed at the nose end 30 of the tab 26 and intersects the diametrical line 27. The cleat 58 extends downwardly towards the public side 34 of the tear panel 20 such that a distance from a lowermost portion of the cleat 58 to the tear panel 20 is less than a distance of an uppermost portion of the cleat 58 from the tear panel 20. The distance of the lowermost portion of the cleat 58 from the public side 34 of the tear panel 20 is less than a distance from the tear panel 20 of portions of the curled portion 54 directly adjacent opposing sides of the cleat 58.

In one embodiment, a cleat 58 is formed at the nose end 30 by compressing the curled portion 54 of the tab 26. The cleat 58 intersects the diametrical line 27 and extends downwardly towards the public side 34 of the tear panel 20 relative to segments of the curled portion 54 of the tab 26 directly adjacent to the cleat 58 and on opposing sides thereof. A length L of the tab 26 measured from the longitudinal axis 50 to the radially outermost portion of the cleat 58 is at least 0.008 ins longer than respective lengths of the tab 26 measured from the longitudinal axis 50 to radially outermost segments of the curled portion 54 of the tab 26 located directly adjacent and on opposite sides of the cleat 58. The length L is preferably between 0.008 ins and 0.020 ins, more preferably between 0.008 ins and 0.012 ins, and most preferably between 0.010 ins and 0.012 ins, or any range or combination of ranges therein.

Figure 11:
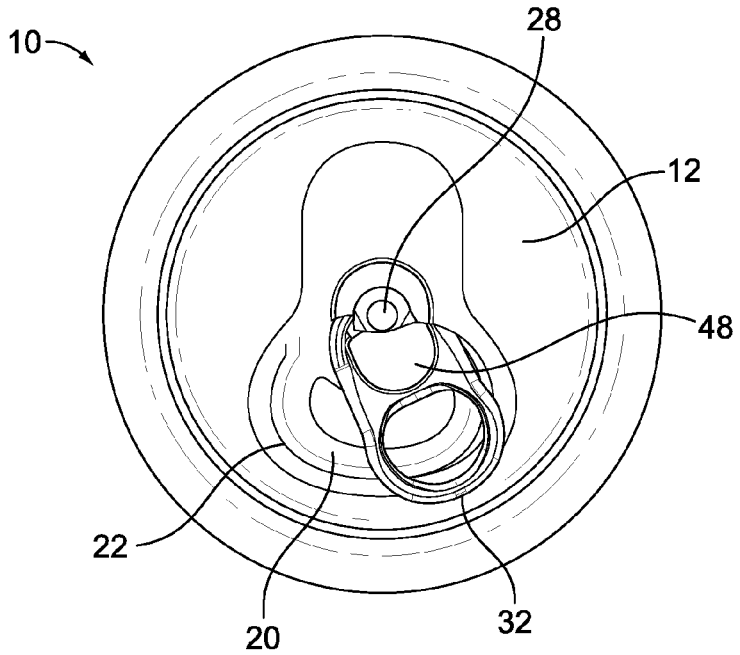
FIG. 11 is a view of a beverage can end in a failure position called a "tuck under;"

The cleat 58 serves several functions. It reduces the likelihood of a tuck under opening failure (see FIG. 11). It reduces the risk of tab 26 rotation about the rivet 28 during the can end opening procedure promoted. Such rotation is promoted by the oblique hinge angle of the tab 28 during opening. The purpose of the present invention is not to lower the magnitude of the force required to produce the "pop" described above. Instead, the cleat 58 reduces the tendency of the nose 30 to slide back. The increased length in the cleat 58 also moves the tab nose 30 down. The cleat 58 also creates a thinner portion at the nose 30, and it smoothly moves the tab nose 30 downwardly towards the tear panel 20. The cleat 58 increases the length of the tab 26 from the center of the rivet 28 to the nose 30 of the tab 26. This allows score depth latitude. Score residuals can be higher. The cleat 58 reduces the tab 26 from sliding back, so it propagates the score quicker which gives a more positive opening. Because of this the tab can be produced from a thinner material.

Prior to the development of the cleat 58, it was more difficult to open the shorter tab 26. One way of improving can end 10 openability is to lower frangible score 22 residual (i.e., the amount of material thickness between a bottom of the score and the produce side 35 of the center panel 12). However, it is not desirable to lower the score residual because lowering/decreasing score residual makes accidental opening or score failure more likely to occur. It also creates issues with metal exposure. Moreover, score burst values (i.e., a magnitude of an internal force which causes the frangible to undesirably fail) will typically decrease with the lowered score residual being less likely to withstand increasing pressure in the sealed container (e.g., from shaking, leave in hot car, etc). Also, the lower score residual increases shipping abuse problems (e.g., premature failure of the score caused by typical shipping and handling). Thus, any design change that results in increasing score residual is an improvement. Furthermore, lowered score residual results in more frequent changes in the score tools more often because they were concerned about wear. So with the added cleat, the score tooling will not need to be changed/replaced as quickly. Thus, tooling costs are reduced.

The terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. A can end for a beverage container comprising:

a curl extending circumferentially about a longitudinal axis;

a circumferential wall extending downwardly from a radially inner portion of the curl;

a circumferential strengthening member joined to lower segment of the circumferential wall; and a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a frangible score in the public side and non-frangible hinge segment;

a tab;

a means for attaching the tab to the center panel spaced from the tear panel; and the tab comprising:

a lift end;

a nose end opposite the lift end and overlying the tear panel;

a rivet island having a rivet aperture;

a void region partially surrounding the rivet island having a first leg extending along a first side of the rivet island and a second leg extending along a second side of the rivet island;

a tab hinge extending between respective terminal ends of the first and second legs of the void region;

a curled portion of the tab defining a portion of the perimeter of the tab and bent downwardly towards the public side of the center panel, the curled portion extending at least from a terminal end of the first leg to a terminal end of the second leg through the lift end; and a cleat formed at the nose end intersecting a diametrical line of the can end drawn through the lift end, the nose end, and the rivet aperture and extending downwardly towards the public side of the tear panel such that a distance from a lowermost portion of the cleat to the tear panel is less than a distance of an uppermost portion of the cleat to the tear panel, the cleat comprising a compressed portion of the curled portion forming a substantially V-shaped crevice on an upper surface of the tab and wherein a bottom surface of the cleat is bow-shaped.

2. The can end of claim 1 wherein the V-shaped crevice comprises a first wall separated from a second wall by a bottom point, the first wall angled from a vertical plane intersecting the bottom point at an angle between 5 and 35 degrees.

3. The can end of claim 2 wherein the second wall is angled from a vertical plane intersecting the bottom point at an angle between 5 and 35 degrees.

4. The can end of claim 3 wherein the compressed portion of the curled portion of the tab extends downwardly towards the public side of the center panel a greater distance than a portion of the curled portion of the tab directly adjacent the compressed portion of the curled portion.

5. The can end of claim 4 wherein the cleat extends outwardly relative to the longitudinal axis and along the diametrical line a greater length than portions of the curled portion of the tab directly adjacent the cleat.

6. The can end of claim 5 wherein the first leg has a length greater than the second leg.

7. The can end of claim 6 wherein the hinge line is at an oblique angle to the diametrical line.

8. The can end of claim 1 wherein the compressed portion of the curl extends downwardly towards the public side of the center panel a greater distance than portions of the curled portion directly adjacent the compressed portion of the curled portion and on opposing sides of the cleat.

9. A can end for a beverage container comprising:

a curl extending circumferentially about a longitudinal axis;

a circumferential wall extending downwardly from a radially inner portion of the curl;

a circumferential strengthening member joined to lower segment of the circumferential wall; and a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a frangible score in the public side and non-frangible hinge segment;

a tab;

a means for attaching the tab to the center panel spaced from the tear panel; and the tab comprising:

a lift end;

a nose end opposite the lift end and overlying the tear panel;

a rivet island having a rivet aperture;

a void region partially surrounding the rivet island having a first leg extending along a first side of the rivet island and a second leg extending along a second side of the rivet island wherein the first leg has a length greater than the second leg;

a tab hinge extending between respective terminal ends of the first and second legs of the void region wherein the hinge line is at an obtuse angle to a diametrical line of the can end drawn through the lift end, the nose end, and the rivet aperture; and a cleat formed at the nose end and extending outwardly relative to the longitudinal axis from the nose end along the diametrical line and wherein an angle between a bottom surface of the tab and the public side of the center panel is reduced by the cleat.

10. The can end of claim 9 wherein the cleat extends outwardly relative to the longitudinal axis a greater length than curled portions of the tab directly adjacent to and on opposing sides of the cleat.

11. The can end of claim 10 wherein the cleat intersects the diametrical line.

12. The can end of claim 11 wherein the cleat extends downwardly relative to portions of the tab directly adjacent to the cleat.

13. The can end of claim 9 wherein an upper surface of the cleat is V-shaped transverse to the diametrical line.

14. The can end of claim 13 wherein a bottom surface of the cleat is bow-shaped transverse to the diametrical line.

15. The can end of claim 14 wherein a curled portion of the tab defines at least a portion of a perimeter of the tab from an end of the first leg to an end of the second leg through the nose end of the tab, including the cleat, and wherein the cleat comprises a compressed portion of the curled portion extending downwardly towards the public side of the center panel a greater distance than portions of the curled portion of the tab directly adjacent the compressed portion of the curled portion and on opposing sides of the cleat.

16. The can end of claim 15 wherein the diametrical line bisects the cleat.

17. The can end of claim 16 wherein an upper surface of the cleat is V-shaped transverse to the diametrical line.

18. A can end for a beverage container comprising:

a curl extending circumferentially about a longitudinal axis;

a circumferential wall extending downwardly from a radially inner portion of the curl;

a circumferential strengthening member joined to lower segment of the circumferential wall; and a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a frangible score in the public side and non-frangible hinge segment; and a tab;

a means for attaching the tab to the center panel spaced from the tear panel; and the tab comprising:

a lift end;

a nose end opposite the lift end and overlying the tear panel;

a rivet island having a rivet aperture;

a void region partially surrounding the rivet island having a first leg extending along a first side of the rivet island and a second leg extending along a second side of the rivet island wherein the first leg has a length greater than the second leg;

a tab hinge extending between respective terminal ends of the first and second legs of the void region wherein the hinge line is at an obtuse angle to a diametrical line of the can end drawn through the lift end, the nose end, and the rivet aperture;

a cleat formed at the nose end intersecting the diametrical line and extending downwardly towards the public side of the tear panel such that a distance from a lowermost portion of the cleat to the tear panel is less than a distance of an uppermost portion of the cleat from the tear panel and a bottom surface of the cleat is bow-shaped transverse to the diametrical line.

19. A can end for a beverage container comprising:

a curl extending circumferentially about a longitudinal axis;

a circumferential wall extending downwardly from a radially inner portion of the curl;

a circumferential strengthening member joined to lower segment of the circumferential wall; and a center panel about which the circumferential strengthening member extends having a public side opposite a product side, the center panel comprising:

a peripheral edge defining a radially outer perimeter of the center panel;

a tear panel spaced radially inwardly from the peripheral edge, the tear panel defined by a frangible score in the public side and non-frangible hinge segment;

a tab;

a rivet attaching the tab to the center panel spaced from the tear panel; and the tab comprising:

a lift end;

a nose end opposite the lift end and overlying the tear panel;

a rivet island having a rivet aperture;

a void region partially surrounding the rivet island having a first leg extending along a first side of the rivet island and a second leg extending along a second side of the rivet island;

a tab hinge extending between respective terminal ends of the first and second legs of the void region;

a curled portion of the tab defining at least a portion of the a perimeter of the tab at the nose end of the tab and bent downwardly towards the public side of the center panel; and a cleat formed at the nose end intersecting a diametrical line of the can end drawn through the lift end, the nose end, and the rivet aperture and extending downwardly towards the public side of the tear panel relative to segments of the curled portion of the tab directly adjacent to the cleat and on opposing sides thereof wherein a first length of the tab measured from the longitudinal axis to the radially outermost portion of the cleat is at least 0.008 ins longer than respective lengths of the tab measured from the longitudinal axis to radially outermost segments of the curled portion of the tab located directly adjacent and on opposite sides of the cleat and an upper surface of the cleat has a different shape than a bottom surface of the cleat in a cross-section taken transverse to the diametrical line.

* * * * *

UNITED STATES PATENT AND TRADEMARK OFFICE

CERTIFICATE OF CORRECTION

PATENT NO. : 8,646,643 B2
APPLICATION NO. : 13/495369
DATED : February 11, 2014
INVENTOR(S) : Randall G. Forrest, Jonathan P. Meyer and Derek J. Siegal It is certified that error appears in the above-identified patent and that said Letters Patent is hereby corrected as shown below:

In the Claims

Column 15, Lines 1-2 In Claim 19, delete "the a" and insert -- a --, therefor.

Signed and Sealed this
Twenty-fourth Day of February, 2015

Michelle K. Lee

Michelle K. Lee
*Deputy Director of the United States Patent and Trademark Office*